US009608321B2

(12) United States Patent
Cordone

(10) Patent No.: US 9,608,321 B2
(45) Date of Patent: Mar. 28, 2017

(54) RADOME HAVING LOCALIZED AREAS OF REDUCED RADIO SIGNAL ATTENUATION

(71) Applicant: GOGO LLC, Itasca, IL (US)

(72) Inventor: Sean Scott Cordone, Wheaton, IL (US)

(73) Assignee: GOGO LLC, Chicago, IL (US)

( * ) Notice: Subject to any disclaimer, the term of this patent is extended or adjusted under 35 U.S.C. 154(b) by 30 days.

(21) Appl. No.: 14/209,698

(22) Filed: Mar. 13, 2014

(65) Prior Publication Data

US 2015/0130671 A1 May 14, 2015

Related U.S. Application Data

(60) Provisional application No. 61/902,549, filed on Nov. 11, 2013.

(51) Int. Cl.

| | |
|---|---|
| ***H01Q 1/42*** | (2006.01) |
| ***H01Q 1/28*** | (2006.01) |
| ***H01Q 21/28*** | (2006.01) |

(52) U.S. Cl.

CPC ..... *H01Q 1/42* (2013.01); *H01Q 1/28* (2013.01); *H01Q 1/422* (2013.01); *H01Q 21/28* (2013.01)

(58) Field of Classification Search

CPC ..... H01Q 1/28; H01Q 1/42; H01Q 1/405
USPC ..... 343/705, 872, 909
See application file for complete search history.

(56) References Cited

U.S. PATENT DOCUMENTS

| | | | | |
|---|---|---|---|---|
| 5,208,603 | A * | 5/1993 | Yee | H01Q 15/0026 343/872 |
| 5,652,631 | A * | 7/1997 | Bullen | H01Q 1/281 343/753 |
| 5,861,860 | A * | 1/1999 | Stanek | H01Q 15/0013 343/708 |
| 6,512,485 | B2 * | 1/2003 | Luly | H01Q 19/132 343/753 |
| 6,627,296 | B1 * | 9/2003 | Tudela | B32B 3/12 428/182 |
| 7,151,504 | B1 * | 12/2006 | Boatman | H01Q 1/422 343/872 |
| 7,463,212 | B1 * | 12/2008 | Ziolkowski | H01Q 1/42 343/872 |
| 8,009,112 | B2 * | 8/2011 | Buer | H01Q 3/2658 343/700 MS |
| 2003/0164805 | A1 * | 9/2003 | Strickland | H01Q 21/067 343/895 |

(Continued)

FOREIGN PATENT DOCUMENTS

| | | |
|---|---|---|
| JP | 2010041201 A | 2/2010 |
| JP | 2011041130 A | 2/2011 |

OTHER PUBLICATIONS

International Search Report and Written Opinion for corresponding International Application No. PCT/US2014/064743, mailing date Feb. 18, 2015.

*Primary Examiner* — Dameon E Levi
*Assistant Examiner* — Ab Salam Alkassim, Jr.
(74) *Attorney, Agent, or Firm* — Marshall, Gerstein & Borun LLP; Randall G. Rueth

(57) ABSTRACT

A radome having localized areas of reduced radio signal attenuation includes a body having a first portion and a second portion. The first portion has a reduced radio signal attenuation property in a transmit band and a second portion has a reduced radio signal attenuation property in a reception band.

18 Claims, 11 Drawing Sheets

(56) References Cited

U.S. PATENT DOCUMENTS

| | | | | |
|---|---|---|---|---|
| 2006/0238404 | A1* | 10/2006 | Ikeda | G01S 7/032<br>342/70 |
| 2007/0216599 | A1* | 9/2007 | Slattery | H01Q 1/526<br>343/872 |
| 2009/0096687 | A1* | 4/2009 | Gentilman | B28B 1/00<br>343/705 |
| 2012/0105300 | A1* | 5/2012 | Ando | G01S 7/032<br>343/872 |
| 2012/0326915 | A1* | 12/2012 | Hill | G01S 13/9303<br>342/30 |
| 2013/0009846 | A1* | 1/2013 | Freitag | H01Q 1/281<br>343/872 |

* cited by examiner

RADOME HAVING LOCALIZED AREAS OF REDUCED RADIO SIGNAL ATTENUATION

RELATED APPLICATIONS

This application is a non-provisional application that claims priority benefit of U.S. Provisional Patent Application No. 61/902,549, filed Nov. 11, 2013, the entirety of which is hereby incorporated by reference herein.

BACKGROUND

Field of the Invention

The invention generally relates to radomes and more specifically to aircraft radomes having localized areas with different radio signal attenuation properties.

Related Technology

A radome is a structural, weather proof enclosure that protects a radar or radio antenna. Radomes protect antenna surfaces from weather and/or conceal antenna electronic equipment from view. Radomes also protect personnel from being injured from moving parts of the antenna. Radomes also improve the aerodynamic profile of an aircraft in the vicinity of the radome.

Radomes may have different shapes, such as spherical, geodesic, planar, etc., based on the intended use. Radomes are often made from fiberglass, PTFE coated fabrics, plastics, or other low weight, but structurally strong materials.

Fixed wing aircraft often use radomes to protect radar or radio antennas that are disposed on the aircraft body. For example, many aircraft include radomes that take the form of a nose cone on the forward end of the aircraft body to protect forward looking radar antennas, such as weather radar antennas. Radomes may also be found on the top, bottom, or aft parts of the aircraft body when the radome is protecting a radio communications antenna (e.g., a satellite communications antenna), or on the bottom of aircraft when protecting radio antennas for ground based communication. In these cases, the radomes may look like blisters or small domes on the aircraft body.

Generally, radomes must be large enough to allow free movement of the radar or radio antenna parts. For example, most weather radar antennas are gimbaled for movement about multiple axes. As a result, the weather radar antenna can be pointed in virtually any direction to look for weather in the vicinity of the aircraft. Thus, the radome must have uniform signal transmission and reception properties in all directions so that the radar antenna may be properly calibrated. Additionally, it may be desirable to produce radomes having structural properties that allow them to maintain their shape (so as not to change aerodynamic characteristics of the airframe) even when hit by foreign objects (such as birds) during flight. Because the radome must have uniform signal transmission and reception properties combined with structural strength aircraft radomes the signal transmission and reception properties are often compromised to ensure that the strength requirements are met.

BRIEF DESCRIPTION OF THE DRAWINGS

Further features and advantages of the invention can be gathered from the claims, the following description, and the attached diagrammatic drawings, wherein:

DETAILED DESCRIPTION

Figure 1:
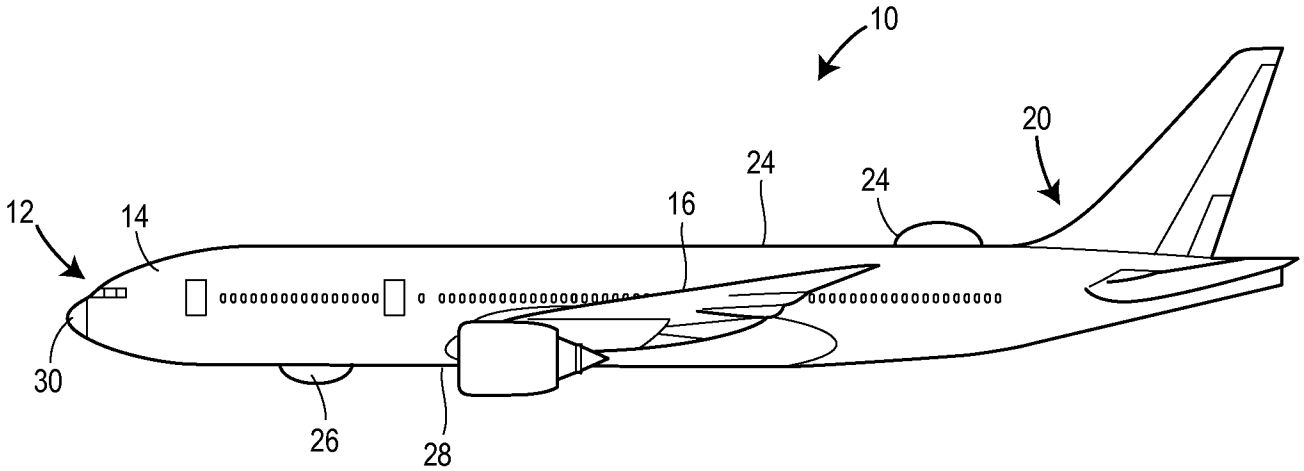
FIG. 1 is a side view of an aircraft having a radome constructed in accordance with the teachings of the disclosure.

Turning now to the Figures, FIG. 1 illustrates an aircraft 10, which has a fuselage or body 14 including a front end 12, a rear or aft end 20, and a pair of wings 16. The aircraft 10 also includes a first radome 22 on an upper or dorsal portion 24 of the fuselage, a second radome 26 on a lower or ventral portion 28 of the fuselage, and a third radome 30 located at the front end 12 of the fuselage 14.

Each of the radomes 22, 26, and 30 may house an antenna that performs a different function. In one example the first radome 22 may house a communications antenna that transmits radio signals to a communications satellite and receives radio signals from a communications satellite. Similarly, in one example, the second radome 26 may house a communications antenna that transmits radio signals to a ground based radio facility and receives radio signals from a ground based radio facility. On the other hand, in one example, the third radome 30 may house a radar antenna that transmits radar energy and receives a reflected portion of the transmitted radar energy to locate weather formations ahead of the aircraft 10. Each of these radomes 22, 26, 30 may have different structural and transmit/receive characteristics. Regardless, each of the radomes 22, 26, and 30 must comply with local regulations, such as FAR Part 25.571, which is hereby incorporated by reference as of the filing date of this application, before being certified for use on aircraft.

Generally, the third radome 30, which houses a radar antenna, is uniform in construction, to allow the radar antenna (which is likely gimbaled), to transmit and receive radar signals with uniform attenuation through the third radome 30 at any point on the third radome 30. In other words, the third radome 30 must have uniform properties at all locations through which radar energy will be transmitted or received. Because the third radome must comply with local regulations governing aircraft damage, the transmission properties of the third radome 30 may be reduced by mechanical strength requirements dictated by these damage regulations. Said another way, mechanical strength requirements and radio signal attenuation properties are often at odds with one another in radome design.

Hereinafter, characteristics attributed to the first radome 22 and to the second radome 26 may be used interchangeably with either radome. For example, characteristics attributed to the first radome 22 may be equally attributable to the second radome 26 and vice versa. Furthermore, characteristics of the first and second radomes 22, 26, may be combined with one another.

In contrast to the third radome 30, the first and second radomes 22, 26, which are constructed in accordance with the teachings of the disclosure, may have decoupled mechanical and radio wave attenuation properties. In other words, the first and second radomes 22, 26, may have localized areas that differ from one another in mechanical strength characteristics and/or in radio wave attenuation characteristics. For example, the first radome 22 may have a first portion that is strong enough to satisfy local damage regulations while having a second portion that has better radio wave attenuation characteristics than the first portion. Said another way, the first radome 22 may have a first portion that is structurally capable of withstanding foreign object impact damage (such as a bird strike) without becoming structurally compromised (i.e., a stronger portion) and a second portion that is structurally weaker than the first portion (because it is located in an area that is not likely to be struck by a foreign object or in a location that requires less physical strength), but that has better radio signal attenuation properties than the first portion.

Figure 2:
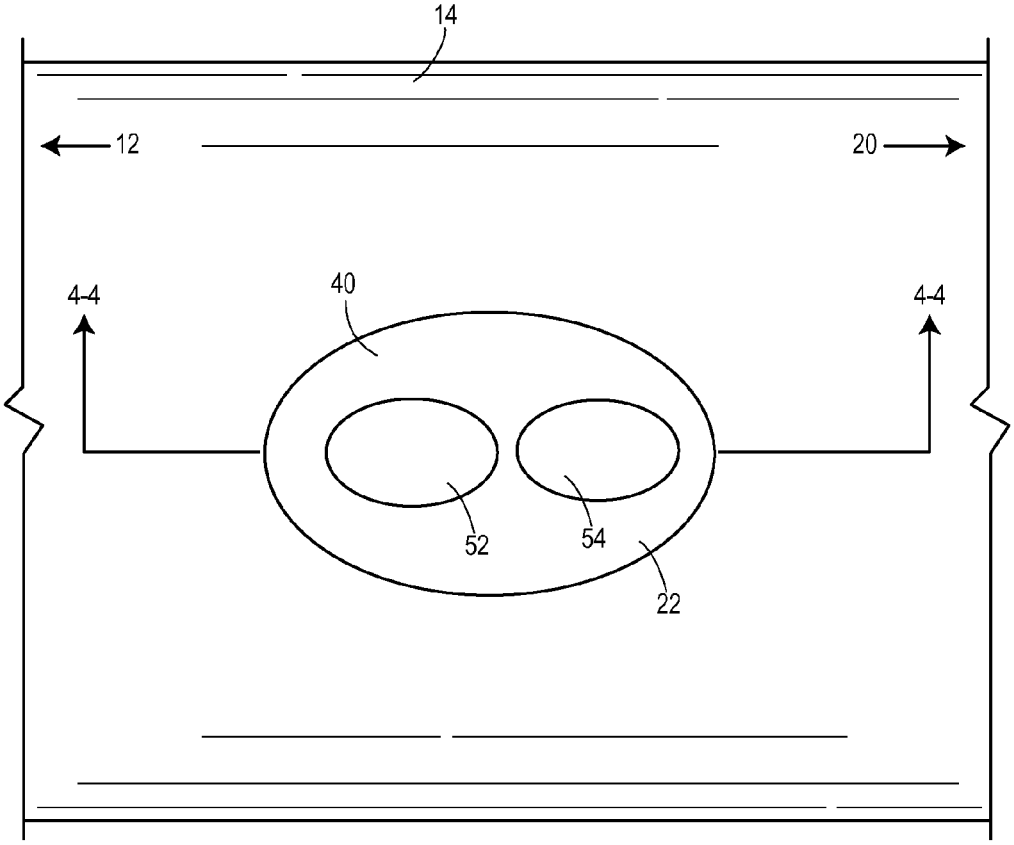
FIG. 2 is a top plan view of the radome of FIG. 1.
Figure 3:
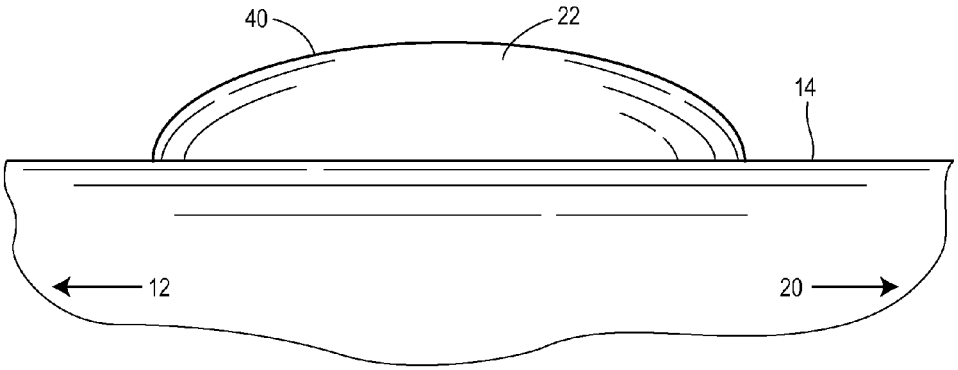
FIG. 3 is a side view of the radome of FIG. 1.
Figure 4:
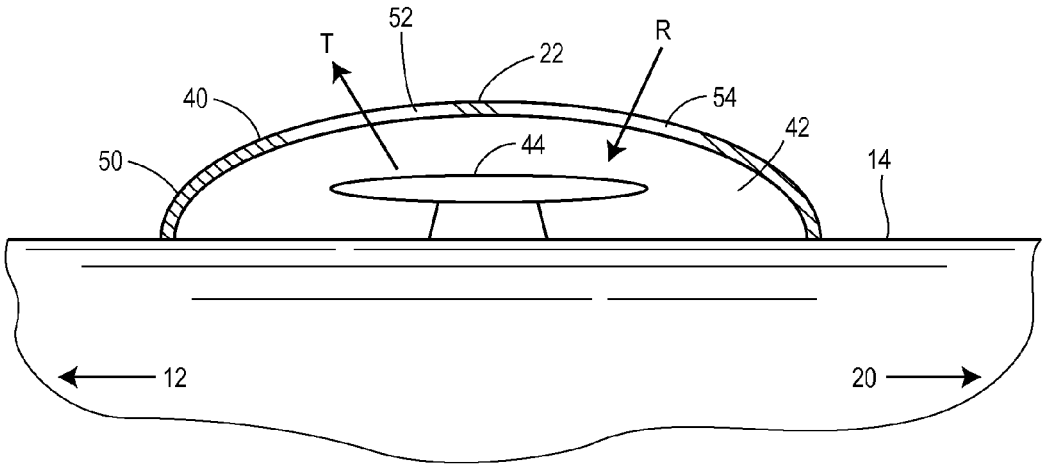
FIG. 4 is a side cross-sectional view of one embodiment of the radome of FIG. 1.

Turning now to FIGS. 2-4, the first radome 22 may comprise an outer shell 40 that is attached to the fuselage 14 of the aircraft 10. The outer shell 40 may form an enclosure 42 that is sized and shaped to house an antenna 44 (FIG. 4). The outer shell 40 may have a non-homogeneous structure. In other words, the outer shell 40 may have physical characteristics that differ from one location to another location.

In one embodiment, the antenna 44 may be a phased array antenna that is mechanically steered. Phased array antennas generally include localized transmission areas and localized reception areas that are electronically or mechanically manipulated to synthesize an electromagnetic beam of radio energy in a desired direction. As a result, a phased array antenna may be located very close to the fuselage 14 of the aircraft 10 and the outer shell 40 may be located very close to the antenna 44 (because the antenna is not significantly moved during operation). Thus, the profile of the outer shell 40 may be minimized.

The outer shell 40 may have a first portion 50, which is at least partially oriented towards the front end 12 of the aircraft 10, a second portion 52, which is oriented aft of the first portion 50, and a third portion 54, which is oriented aft of the second portion 52. The first portion 50 may be the strongest portion structurally. The first portion 50 may be capable of withstanding foreign object damage while the aircraft 10 is in flight without becoming compromised. For example, the first portion 50 may be strong enough to withstand an impact from a four pound bird at the aircraft's maximum design cruise speed (Vc) at sea level or at 0.85 Vc at 8,000 feet without compromising the ability of the aircraft 10 to successfully complete a flight.

Due to the added strength, the first portion 50 has greater radio signal attenuation than the second and third portions 52, 54. The second portion 52, because it is angled with respect to a direction of flight (e.g., the second portion 52 is oriented at a more acute angle with respect to the actual flight path of the aircraft than the first portion 50), will not require the same structural strength as the first portion 50. Thus, the second portion 52 may be designed to reduce radio signal attenuation at the expense of structural strength or rigidity. For example, a transmission signal T transmitted through the second portion 52 may be less attenuated than the same transmission signal T when transmitted through the first portion 50 because the second portion 52 is made of materials (or structures) that allow better transmission of radio signals than the materials (or structures) of the first portion 50. As a result, the antenna 44 may require less power to perform its communication function than an antenna housed by a conventional uniformly constructed radome. While the overall attenuation reduction may depend on design constraints, in some cases, a signal may experience an attenuation reduction of 2 dB or more when transmitted through the second portion 52 than when transmitted through the first portion 50.

Similarly, the third portion 54, because it is on the rear side of the radome, will not require the same structural strength as the first portion 50 because the third portion 54 is protected from impacts by shadowing from the forward structure. Thus, the third portion 54 may be designed to reduce radio signal attenuation, similar to the second portion 52. For example, a receive signal R received through the third portion 54 may be less attenuated than the same receive signal R when received through the first portion 50. Similar to the second portion 52, in some cases, a signal received through the third portion 54 may experience an attenuation reduction of 2 dB or more when compared to the same signal received through the first portion 50. The second and third portions 52, 54 may be designed to reduce attenuation for either a transmission signal or a receive signal. Optionally, the second and third portions 52, 54 may be designed to reduce attenuation for both transmission signals and for receive signals.

Figure 5:
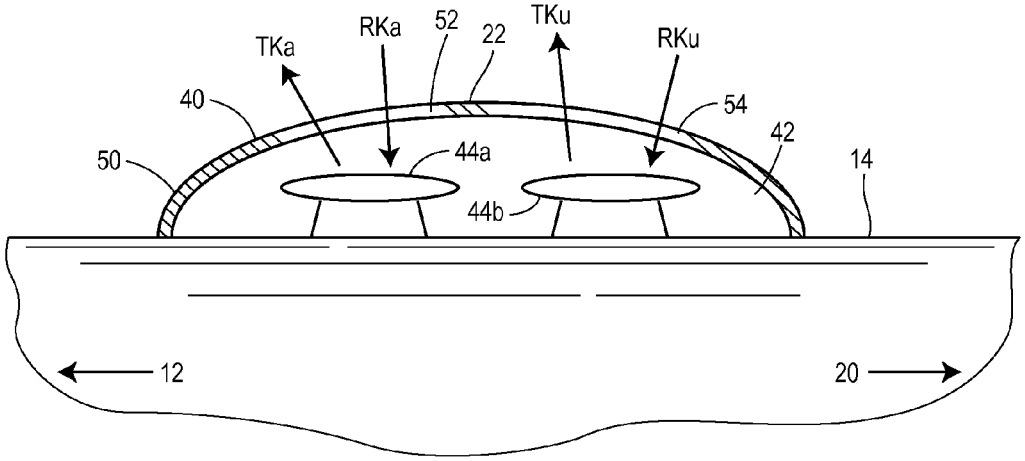
FIG. 5 is a side cross-sectional view of another embodiment of the radome of FIG. 1.

A second embodiment of the radome 22 is illustrated in FIG. 5. In the embodiment of FIG. 5, the second portion 52 and the third portion 54 are designed to reduce attenuation of different frequency bands of radio signals. A first antenna **44*a* may transmit and receive radio signals in a first frequency band (e.g., a Ka band) and a second antenna 44*b* may transmit and receive radio signals in a second frequency (e.g., a Ku band). A first transmit signal TKa or a first receive signal RKa may be less attenuated when transmitted or received through the second portion 52 than through the first portion 50 or than through the third portion 54. While the overall attenuation reduction depends on design constraints, in some cases, a Ka signal or a Ku signal that is transmitted or received through the second portion 52 may experience an attenuation reduction of 2 dB or more when compare to the same signal transmitted or received through the first portion 50. Similarly, a second transmit signal TKu or a second receive signal RKu may be less attenuated when transmitted or received through the third portion 54 than when transmitted through the first portion 50 or through the second portion 52**.

Turning now to FIGS. 6-20, another embodiment of a radome 122 (and a mounting assembly) is illustrated. In the embodiment of FIGS. 6-20, structural features that correspond to features of the embodiment illustrated in FIGS. 1-5 are numbered exactly 100 or 200 greater than those of FIGS. 1-5. For example, the radome of FIGS. 6-16 is identified with reference numeral 122 and the radome of FIGS. 17-21 is identified with reference numeral 222, while the radome of FIGS. 1-5 is identified with the reference numeral 22.

Figure 6:
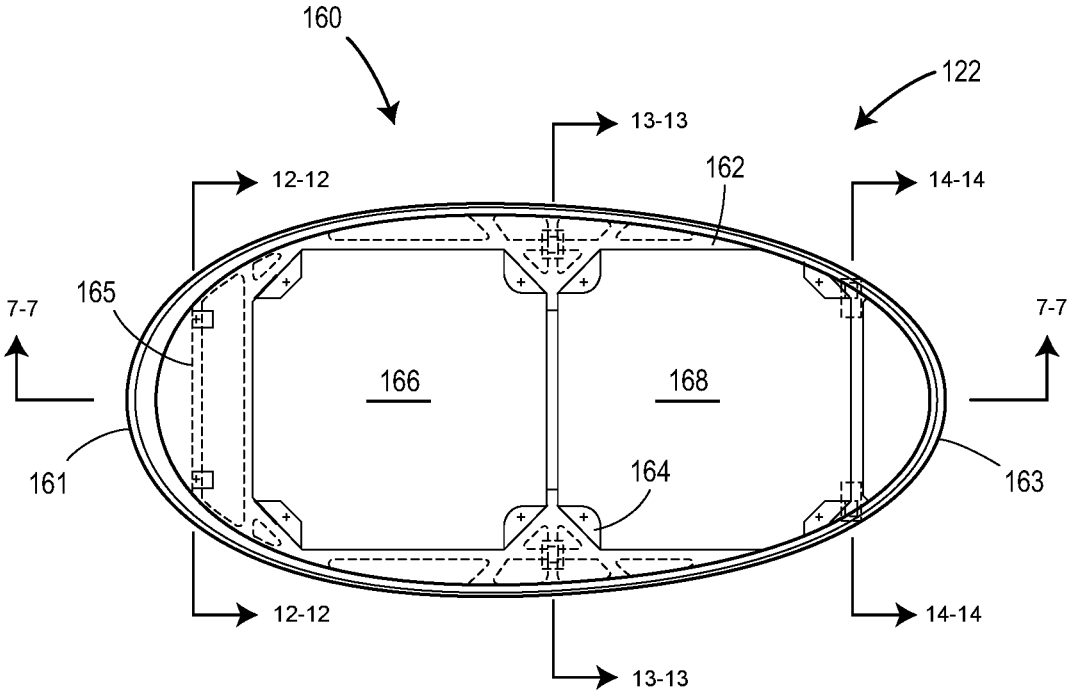
FIG. 6 is a top cutaway view of another embodiment of a radome and mounting assembly constructed in accordance with the teachings of the disclosure.

Referring now to FIGS. 6-16, the radome 122 may include a front end 161 and an aft end 163. The radome 122 may be attached to the aircraft with a mounting assembly 160. The mounting assembly 160 may include a fuselage mounting portion 165 and an antenna mounting portion 162. The antenna mounting portion 162 may include one or more antenna mounting pads 164 for securing an antenna (not shown) to the mounting assembly 160. In some embodiments, the mounting assembly 160 may include a single antenna mounting location. However, as illustrated in FIG. 6, other embodiments may include a plurality of mounting locations, such as a first mounting location 166 and a second mounting location 168. The first and second mounting locations 166, 168 may be adapted to mount similar or dissimilar radio antennas.

The radome 122 may include a main body portion 170 that extends from the mounting assembly in a direction away from the aircraft fuselage 14, and a skirt portion 172. The skirt portion 172 aerodynamically connects the main body portion 170 to the aircraft fuselage. In one embodiment, the skirt portion may be formed of 3/32 inch thick aluminum sheeting. In other embodiments, the skirt portion 172 may be formed from 0.125 inch thick 6061-T6 aluminum sheeting.

The main body portion 170 may include a structurally strong first portion 150 near the front 161 of the radome 122, a reduced attenuation or second portion 152, aft of the front 161, another reduced attenuation or third portion 154 aft of the second portion 152, and another structurally strong first portion 150 aft of the third portion 154. The structurally strong first portion 150 may form a circumference of the main body portion 170, above the skirt portion 172. The second portion 152 and the third portion 154 may be separated by the first portion 150, or the second portion 152 and the third portion 154 may be joined to one another without any intermediate structures. In still other embodiments, the second portion 152 and the third portion 154 may be combined to form a single reduced attenuation portion.

Figure 7:
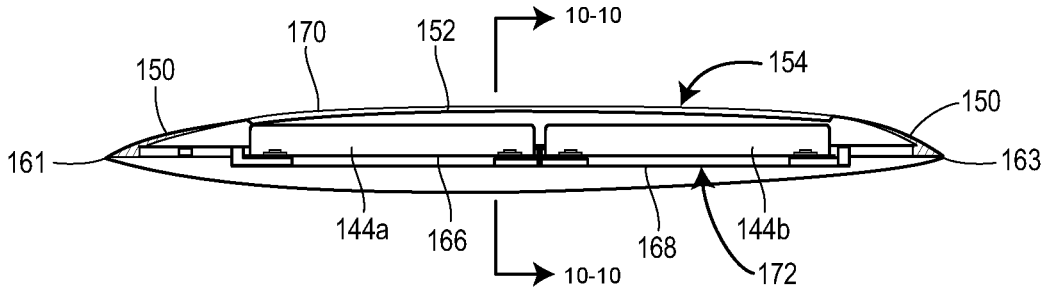
FIG. 7 is a side view of the radome and mounting assembly of FIG. 6.
Figure 8:
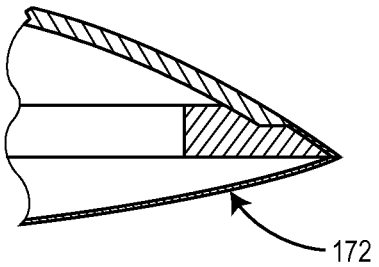
FIG. 8 is a close up side view of an aft portion of the radome and mounting assembly of FIG. 6.
Figure 9:
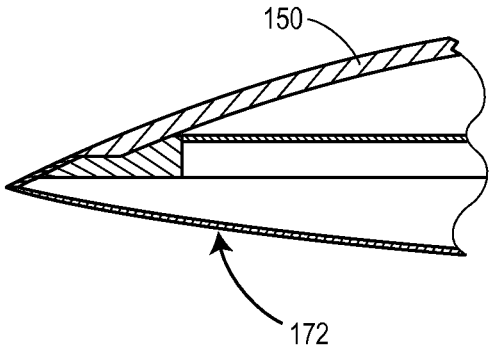
FIG. 9 is a close up side view of a forward portion of the radome and mounting assembly of FIG. 6.
Figure 10:
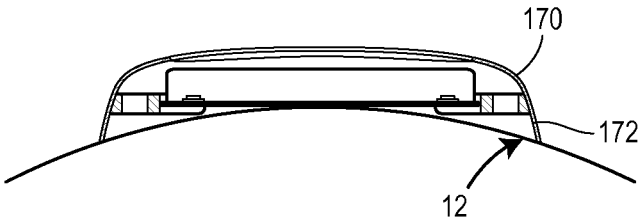
FIG. 10 is a front cross-sectional view of the radome and mounting assembly of FIG. 6, taken along line 10-10.
Figure 11:
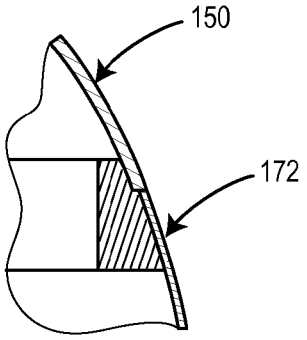
FIG. 11 is a front cutaway view of a right side of the radome and mounting assembly of FIG. 10.

A first antenna 144*a* may be disposed in the first mounting location 166 and a second antenna 144*b* may be disposed in the second mounting location 168, as illustrated in FIG. 7. The first antenna 144*a* and the second antenna 144*b* may be spaced apart from an inner surface of the second portion 152 and the third portion 154, respectively. The second portion 152 may be optimized to reduce radio signals transmitted to/from the first antenna 144*a* and the third portion 154 may be optimized to reduce radio signals transmitted to/from the second antenna 144*b*. In one embodiment, the first portion 152 and the second portion 154 may be formed from a ¾ inch thick honeycomb panel while the first portion 150 may be formed from a ¼ inch thick laminate panel.

Figure 12:
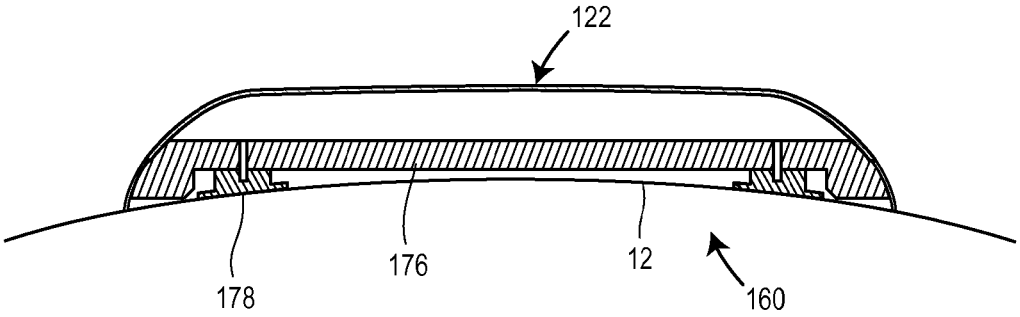
FIG. 12 is a front cross-sectional view of the radome and mounting assembly of FIG. 6, taken along line 12-12.
Figure 13:
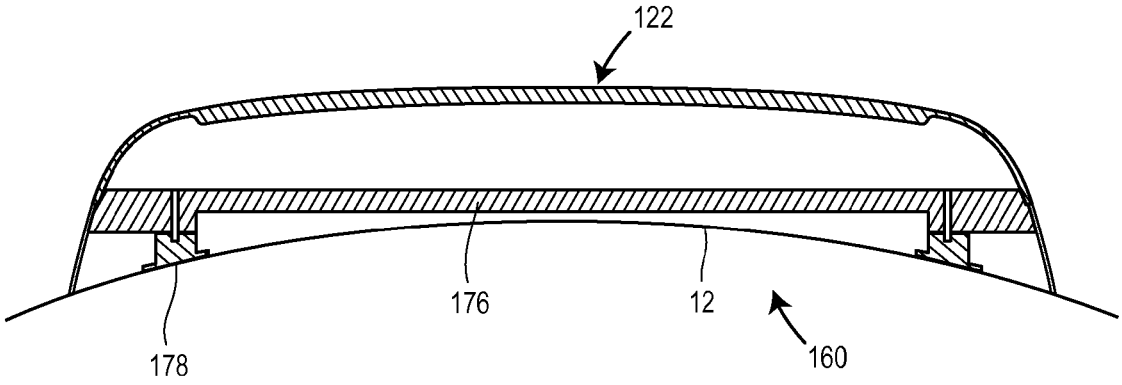
FIG. 13 is a front cross-sectional view of the radome and mounting assembly of FIG. 6, taken along line 13-13.
Figure 14:
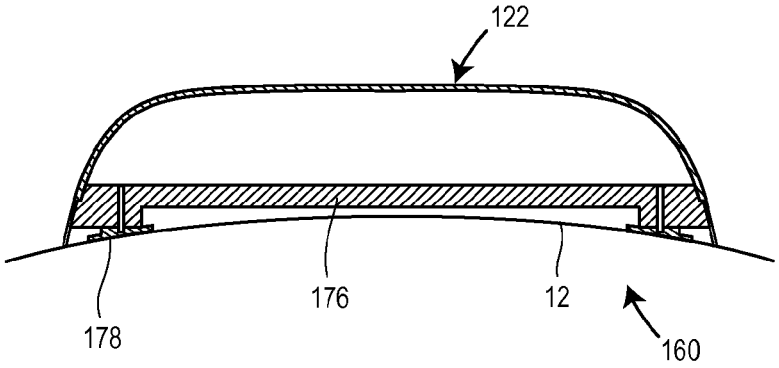
FIG. 14 is a front cross-sectional view of the radome and mounting assembly of FIG. 6, taken along line 14-14.

FIGS. 12-14 illustrate lateral cross-sectional views of the radome 122 and mounting assembly 160, taken along lines 12-12, 13-13, and 14-14 from FIG. 6, respectively. The mounting assembly 160 includes an adapter plate 176 that forms the fuselage mounting portion 165 and the antenna mounting portion 162. The adapter plate 176 may be secured to the aircraft fuselage with one or more mounting brackets 178.

Figure 15:
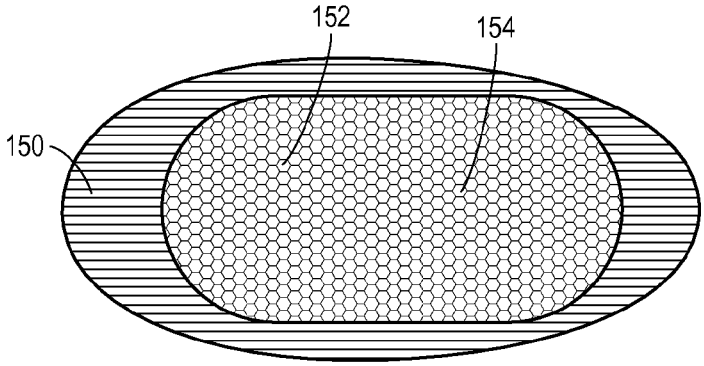
FIG. 15 is a top longitudinal cross-sectional view of the radome of FIG. 6.

FIG. 15 illustrates the first portion 150, second portion 152, and third portion 154 of the radome 122, taken in longitudinal cross-section. The first portion 150 may be formed from ¼ inch thick laminate plating, which is relatively strong, at least strong enough to meet the requirements of FAR Part 25.571 (i.e., The first portion 150 must be able to withstand an impact with a 4-pound bird when the velocity of the airplane relative to the bird along the airplane's flight path is equal to $V_c$ at sea level or 0.85 $V_c$ at 8,000 feet). The second portion 52 may be formed from a paneling sandwich of high dielectric plies separated by low dielectric filler that has reduced radio wave attenuation when compared to the first portion 150.

Figure 16:
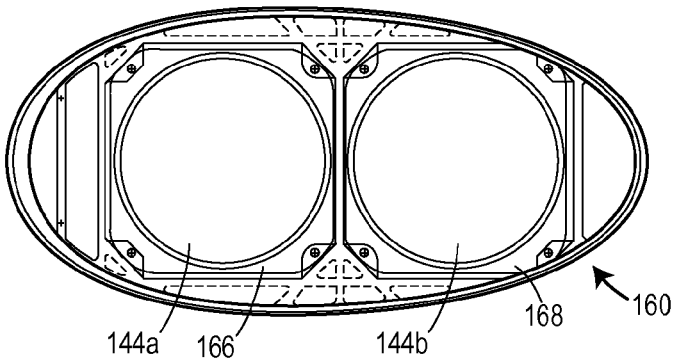
FIG. 16 is a top view of an adapter plate of the mounting assembly of FIG. 6 with antennas installed in mounting areas.
Figure 17:
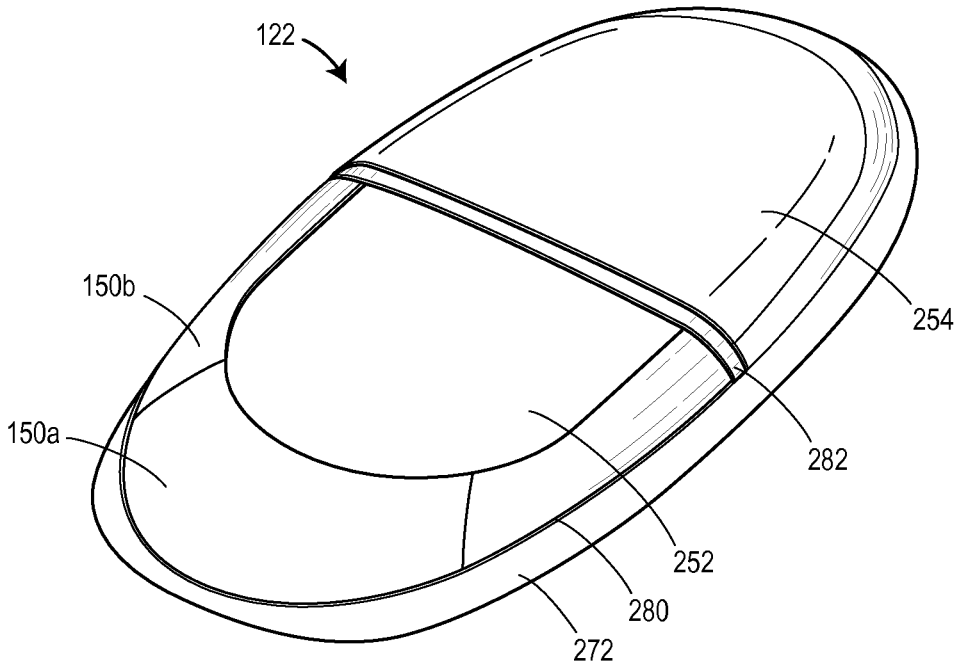
FIG. 17 is a top perspective cross-sectional view of another embodiment of a radome and mounting assembly constructed in accordance with the teachings of the disclosure.

FIG. 16 illustrates the mounting assembly 160 with the first antenna 144*a* installed in the first mounting location 166 and the second antenna 144*b* installed in the second mounting location 168.

FIGS. 17-21 illustrate another embodiment of a radome 222. The radome 222 includes a structurally strong first portion 250*a*, 250*b*, a reduced radio wave attenuation second portion 252, which forms a reception window, and a reduced radio wave attenuation third portion 254, which forms a transmit window. The radome 222 also includes a skirt 272, which aerodynamically connects the radome 222 to an aircraft fuselage, and an edgeband portion 280 that connects the first portion 250*a*, 250*b* with the skirt portion 272. The second portion 252 and the third portion 254 may be connected to one another with a cross bridge 282.

In one embodiment, the first portion 250*a*, the first portion 250*b*, the second portion 252, and the third portion 254 may be formed from an A-sandwich, C-sandwich, laminate, or half-wave structure. Similarly, the edgeband 280 and the cross bridge 282 may be formed from an A-sandwich, C-sandwich, laminate, or half-wave structure.

Figure 18:
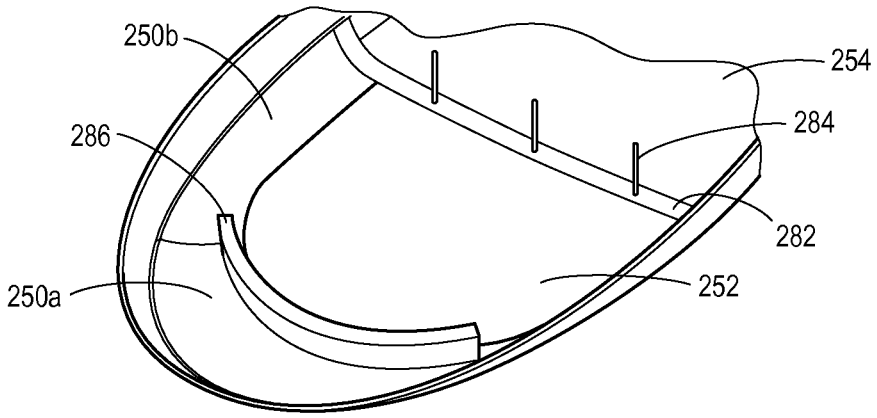
FIG. 18 is a partial bottom perspective cross-sectional view of the radome of FIG. 17.
Figure 19:
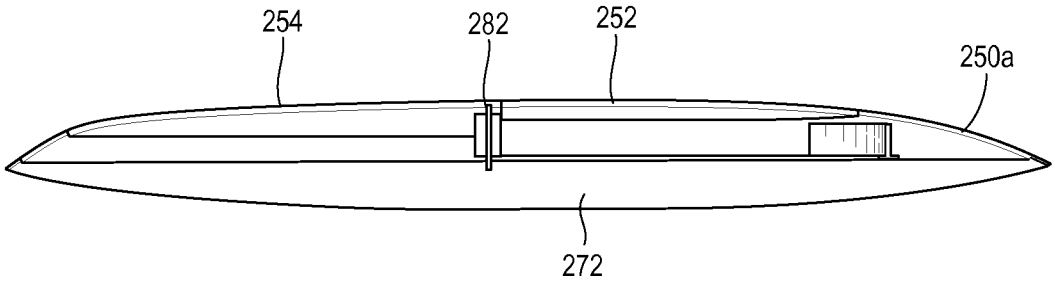
FIG. 19 is a side cross-sectional view of the radome of FIG. 17.
Figure 20:
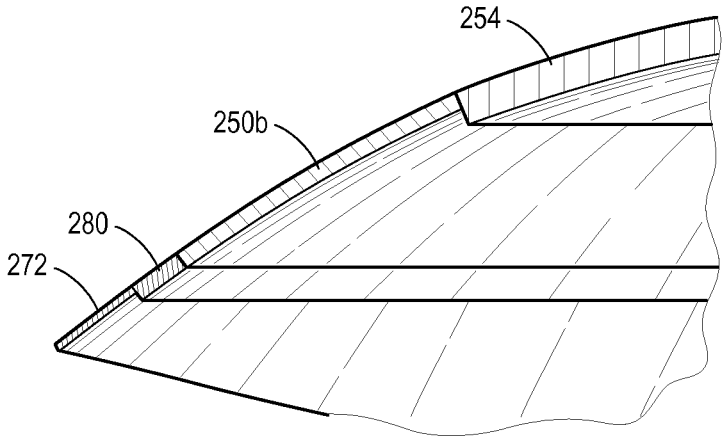
FIG. 20 is a close up side cross-sectional view of a forward portion of the radome of FIG. 17.
Figure 21:
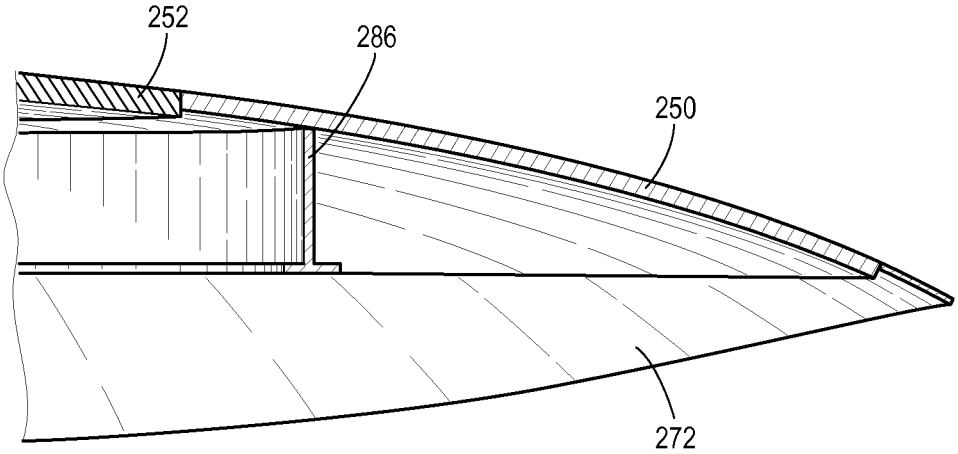
FIG. 21 is a close up side cross-sectional view of an aft portion of the radome of FIG. 17.

In one embodiment, the cross bridge 282 may include a plurality of support posts 284 that extend inward from an inner surface of the radome 222, as illustrated in FIG. 18. The support 284 posts may be formed from 0.25 inch outer diameter 6061-T6 aluminum, or other suitable material. The support posts 284 maintain proper distance of the inner surface of the radome 222 from the first antenna and the second antenna so that the antennas are not damaged during impacts.

The radome may also include a bulkhead plate 286 that extends from an inner surface of the first portion 250*a*. The bulkhead plate 286 structurally reinforces the first portion 152 without interfering with a line of sight transmission or reception to/from the antennas. In one embodiment, the bulkhead plate may be formed from 0.25 inch thick 6061-T651 aluminum, or other suitable material.

In other embodiments, the radomes may have first and second portions having reduced radio signal attenuation (for either transmit and receive bands or for different frequencies), without having a mechanically strong portion.

The disclosed radomes solve the problem of decoupling mechanical strength requirements from radio signal transmission and receiving attenuation requirements. The disclosed radomes also solve the problem of minimizing radio signal attenuation across different radio signal frequencies. As a result, the disclosed radomes are lighter weight with better performance than known homogeneous radomes.

The disclosure is not limited to aircraft radomes. The disclosure could be applied to virtually any radome having localized areas of reduced radio signal attenuation. For example, the disclosed radomes may be used on any type of vehicle (e.g., automobiles, trains, boats, submarines, etc.) or stationary radar facilities. The features of the invention disclosed in the description, drawings and claims can be individually or in various combinations for the implementation of the different embodiments of the invention.

The invention claimed is:

1. A radome for an aircraft, the radome comprising:

a shell having a front end and an aft end, the shell forming an outer surface of an enclosure when mounted on an aircraft, the enclosure being sized and shaped to house a first radio antenna and a second radio antenna, and wherein the shell includes a first portion forming a transmission window and a second portion forming a reception window, the first portion having a reduced radio signal attenuation property for a radio signal having a transmission frequency when compared to the second portion and the second portion having a reduced radio signal attenuation property for a radio signal having a reception frequency when compared to the first portion, the radio signal transmission frequency and the radio signal reception frequency being different frequencies, wherein the first portion is located towards the front end of the shell and the second portion is located aft of the first portion; and wherein the first portion and the second portion are joined by a cross bridge having a plurality of support posts extending downward, away from an inner surface of the shell, the support posts maintaining clearance from a mounting assembly during radome impacts.

2. The radome of claim 1, wherein the transmission frequency is one of a Ka frequency and a Ku frequency.

3. The radome of claim 1, wherein the receive frequency is one of a Ka frequency and a Ku frequency.

4. The radome of claim 1, wherein the first radio antenna is a mechanically steered phased array antenna.

5. The radome of claim 1, further comprising a third portion that has a reduced radio signal attenuation property when compared to the first portion.

6. The radome of claim 5, wherein the second portion has reduced radio signal attenuation property across a transmit band and the third portion has a reduced radio signal attenuation property across a receive band.

7. The radome of claim 6, wherein a radio transmit signal has an attenuation reduction of 2 dB or more when transmitted through the second portion than when transmitted through the first portion.

8. The radome of claim 5, wherein the first portion is mechanically stronger than the second portion and the third portion, and the second portion is mechanically stronger than the third portion.

9. The radome of claim 5, wherein the first portion is formed from one of an A-sandwich, a C-sandwich, a laminate, and a half-wave structure.

10. The radome of claim 5, wherein the second portion is formed from one of an A-sandwich, a C-sandwich, a laminate, and a half-wave structure.

11. The radome of claim 5, wherein the third portion is formed from one of an A-sandwich, a C-sandwich, a laminate, and a half-wave structure.

12. The radome of claim 1, wherein the cross bridge is formed from one of an A-sandwich, a C-sandwich, a laminate, and a half-wave structure.

13. The radome of claim 5, further comprising a skirt portion extending from the first portion.

14. The radome of claim 13, wherein the skirt portion is joined to the first portion with an edgeband.

15. An aircraft having a radome with a localized area of reduced radio signal attenuation, the aircraft comprising:

a fuselage having a first end and a second end;

a pair of wings attached to the fuselage, and a radome attached to the fuselage, the radome including;

a shell having a front end and an aft end, the shell forming an outer surface of an enclosure when attached to the fuselage, the enclosure being sized and shaped to house a first radio antenna and a second radio antenna, wherein the shell includes a first portion forming a transmission window and a second portion forming a reception window, the first portion having a reduced radio signal attenuation property for a radio signal having a transmission frequency when compared to the second portion, and the second portion having a reduced radio signal attenuation property for a radio signal having a reception frequency when compared to the first portion, the radio signal transmission frequency and the radio signal reception frequency being different frequencies, wherein the first portion is located towards the front end of the shell and the second portion is located aft of the first portion, and wherein the first portion and the second portion are joined by a cross bridge having a plurality of support posts extending downward, away from an inner surface of the shell, the support posts maintaining clearance from a mounting assembly during radome impacts.

16. The aircraft of claim 15, further comprising a bulkhead plate disposed within the shell, the bulkhead plate mechanically reinforcing a forward portion of the shell without interfering with a line of sight transmission or reception to or from the first and second radio antennas.

17. The aircraft of claim 15, wherein the second radio antenna is a mechanically steered phased array antenna.

18. The aircraft of claim 15, wherein the shell is attached to one of a dorsal portion of an aircraft and a ventral portion of an aircraft.

* * * * *